US012146250B2

(12) United States Patent
Imaizumi et al.

(10) Patent No.: US 12,146,250 B2
(45) Date of Patent: Nov. 19, 2024

(54) SEWING MACHINE

(71) Applicant: BROTHER KOGYO KABUSHIKI KAISHA, Nagoya (JP)

(72) Inventors: Kazutaka Imaizumi, Nagoya (JP); Hidenori Oka, Tokai (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 163 days.

(21) Appl. No.: 17/820,167

(22) Filed: Aug. 16, 2022

(65) Prior Publication Data

US 2023/0099563 A1 Mar. 30, 2023

(30) Foreign Application Priority Data

Sep. 30, 2021 (JP) ..... 2021-160527

(51) Int. Cl.

| | |
|---|---|
| ***D05B 19/12*** | (2006.01) |
| ***D05B 21/00*** | (2006.01) |
| ***D05B 35/12*** | (2006.01) |
| ***D05B 79/00*** | (2006.01) |

(52) U.S. Cl.

CPC ..... *D05B 19/12* (2013.01); *D05B 21/00* (2013.01); *D05B 35/12* (2013.01); *D05B 79/00* (2013.01); *D05D 2205/12* (2013.01)

(58) Field of Classification Search

CPC ..... D05B 19/10; D05B 19/12; D05B 79/00; D05B 35/12; D05C 5/00; D05C 5/02

See application file for complete search history.

(56) References Cited

U.S. PATENT DOCUMENTS

| | | | | |
|---|---|---|---|---|
| 5,042,410 | A * | 8/1991 | Nakashima | D05B 19/02 112/306 |
| 5,072,680 | A * | 12/1991 | Nakashima | D05B 79/00 353/28 |
| 2013/0139739 | A1* | 6/2013 | Naka | D05B 19/105 112/470.05 |
| 2020/0010991 | A1 | 1/2020 | Minematsu et al. | |
| 2020/0299884 | A1 | 9/2020 | Imaizumi | |

FOREIGN PATENT DOCUMENTS

| | | | |
|---|---|---|---|
| JP | 2019-107063 | A | 7/2019 |
| JP | 2020-5694 | A | 1/2020 |

* cited by examiner

*Primary Examiner* — Nathan E Durham
(74) *Attorney, Agent, or Firm* — Oliff PLC

(57) ABSTRACT

The sewing machine includes a projector, a processor, and a memory storing computer-readable instructions that cause the processor to perform processes. The processes include generating processing of generating a first image including a first object representing a first sewing pattern and generating a second image including a second object representing a second sewing pattern. The first sewing pattern is at least a part of the sewing pattern and is a state in which the sewing is incomplete. The second sewing pattern is a part of the sewing pattern and is a state in which the sewing has progressed further than the first sewing pattern. The processes include projection processing of, after causing the projector to project the first image, switching the projected first image, during the sewing, to the second image, and causing the projector to project the second image.

15 Claims, 14 Drawing Sheets

SEWING MACHINE

REFERENCE TO RELATED APPLICATIONS

This application claims priority from Japanese Patent Application No. 2021-160527 filed on Sep. 30, 2021. The entire content of the priority application is incorporated herein by reference.

BACKGROUND ART

The present disclosure relates to a sewing machine.

A sewing machine performs sewing on a sewing object, and projects an image onto the sewing object during the sewing. The image includes a position at which stitches are to be formed, that is, includes a sewing pattern.

DESCRIPTION

For example, even when the sewing with the above-described sewing machine progresses, the projected content of the image does not change. Thus, there is a possibility that a user may find it difficult to ascertain an extent of progress of the sewing from the projected content of the image.

Embodiments of the broad principles derived herein provide a sewing machine that contributes to the advantage of making it easier for a user to ascertain an extent of progress of sewing.

A sewing machine related to one aspect of the present disclosure sews a sewing pattern on a sewing object placed on a bed. The sewing machine includes a projector configured to project an image toward the bed, a processor, and a memory storing computer-readable instructions that, when executed by the processor, cause the processor to perform processes. The processes include generating processing of generating a first image including a first object representing a first sewing pattern and generating a second image including a second object representing a second sewing pattern. The first sewing pattern is at least a part of the sewing pattern and is a state in which a sewing by the sewing machine is incomplete. The second sewing pattern is a part of the sewing pattern and is a state in which the sewing has progressed further than the first sewing pattern. The processes include projection processing of, after causing the projector to project the first image generated by the generating processing, switching the projected first image, during the sewing, to the second image generated by the generating processing, and causing the projector to project the second image.

According to the above-described aspect, the second sewing pattern is a pattern of a state in which the sewing has progressed more than in the first sewing pattern. Thus, by switching from the first image to the second image during the sewing, the sewing machine contributes to the advantage of making it easier for a user to ascertain an extent of progress of the sewing.

Figure 1:
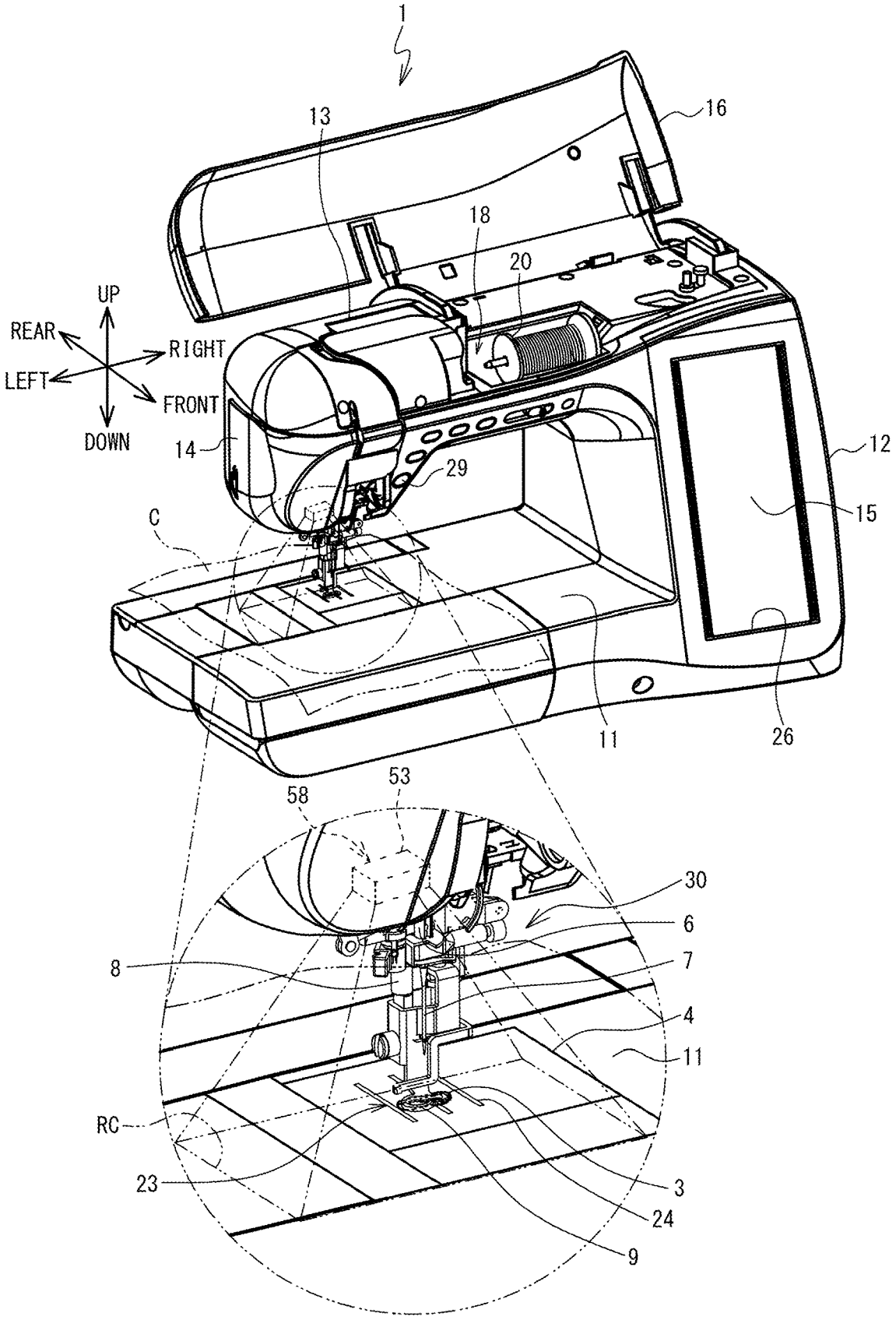
FIG. 1 is a perspective view of a sewing machine.

Hereinafter, an embodiment of the present disclosure will be described with reference to the drawings. The referenced drawings are used for illustrating technological features that can be adopted by the present disclosure. Configurations of devices and flowcharts noted in the drawings are not intended to be limited thereto, and are simply illustrative examples.

A sewing machine 1 sews a sewing pattern on a sewing object, on the basis of sewing data for sewing the sewing pattern. The sewing object is sheet-shaped, and is a cloth C in the present embodiment. The sewing pattern is, for example, a practical pattern. The practical pattern is configured by repeating a unit pattern a plurality of times, where a pattern that is set in advance is the unit pattern. The unit pattern is configured by practical stitches, such as a straight line, a zigzag, overcasting, or the like. In the present embodiment, a so-called decorative pattern, such as a geometrical pattern of a triangular shape or the like, or a schematic pattern of a flower symbol or the like is also included in the practical pattern.

A mechanical configuration of the sewing machine 1 will be described with reference to FIG. 1 and FIG. 2. Hereinafter, the upper side, the lower side, the lower right side, the upper left side, the lower left side, and the upper right side in FIG. 1 are, respectively, the upper side, the lower side, the front side, the rear side, the left side, and the right side of the sewing machine 1.

As shown in FIG. 1, the sewing machine 1 is provided with a bed 11, a pillar 12, an arm 13, and a head portion 14. The bed 11 is a base of the sewing machine 1, and extends in the left-right direction. The cloth C is placed on the upper surface of the bed 11. The pillar 12 extends upward from the right end of the bed 11. The arm 13 extends to the left from the upper end of the pillar 12. The head portion 14 is coupled to the left end of the arm 13, and faces the bed 11 in the up-down direction.

A touch panel display 15 is provided at the front surface of the pillar 12. The touch panel display 15 displays an image and receives operations by a user. Hereinafter, an operation of the touch panel display 15 by the user will be referred to as a "panel operation." The user selects a sewing pattern, a command, and the like by the panel operation.

A start/stop switch 29 is provided at the lower left portion of the front surface of the arm 13. The user operates the start/stop switch 29 when stopping or starting the operation of the sewing machine 1. A cover 16 is provided at the upper portion of the arm 13. The cover 16 is configured to open and close with respect to the arm 13. FIG. 1 shows a state in which the cover 16 is open. A thread housing portion 18 is provided inside the arm 13. A thread spool 20 is housed in the thread housing portion 18. The thread spool 20 is configured by an upper thread being wound thereon.

A needle plate 4 is provided at the upper surface of the bed 11. A needle hole 3 is formed in the needle plate 4. A sewing needle 7 to be described later is inserted into the needle hole 3. A shuttle mechanism (not shown in the drawings) and a feed mechanism 21 (refer to FIG. 3) are provided inside the bed 11. The shuttle mechanism causes the upper thread to be entwined with a lower thread (not shown in the drawings), below the needle plate 4.

The feed mechanism 21 includes a feed dog 24. The feed dog 24 is provided in the bed 11, and is exposed upward from the needle plate 4. The feed dog 24 oscillates in the front-rear direction or the left-right direction due to driving of a feed amount adjustment motor 22 (refer to FIG. 3). The feed mechanism 21 feeds the cloth C in the front-rear direction by the oscillation of the feed dog 24 in the front-rear direction, and feeds the cloth C in the left-right direction by the oscillation of the feed dog 24 in the left-right direction.

Figure 2:
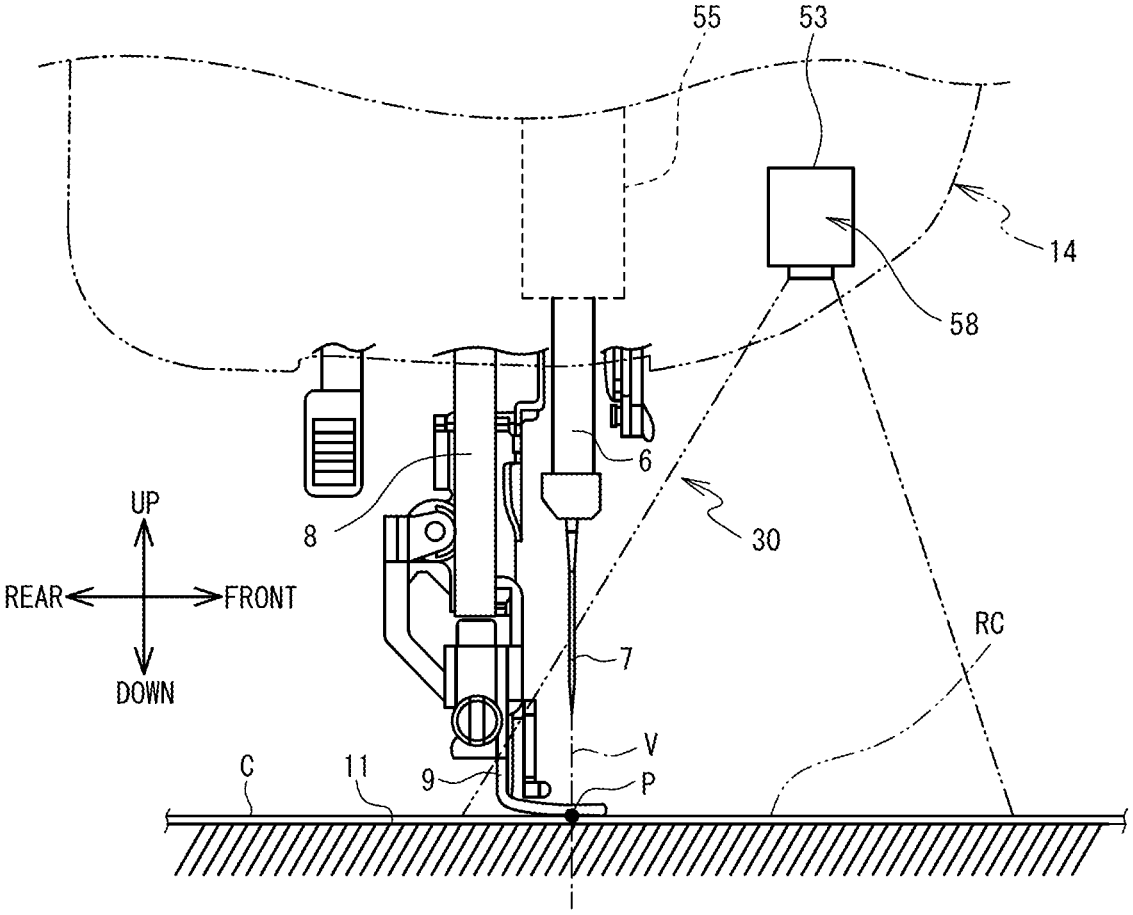
FIG. 2 is a left side view of the sewing machine.

As shown in FIG. 1 and FIG. 2, the sewing machine 1 is provided with a sewing portion 30, a presser bar 8, and a projector 58. The sewing portion 30 includes a needle bar 6, a needle bar up-and-down movement mechanism 55 (refer to FIG. 2), and an oscillating mechanism 57 (refer to FIG. 3). The needle bar 6 is positioned above the needle hole 3 (refer to FIG. 1), and extends downward from the head portion 14. The sewing needle 7 is detachably mounted to the lower end of the needle bar 6. The sewing needle 7 extends downward from the needle bar 6.

Figure 3:
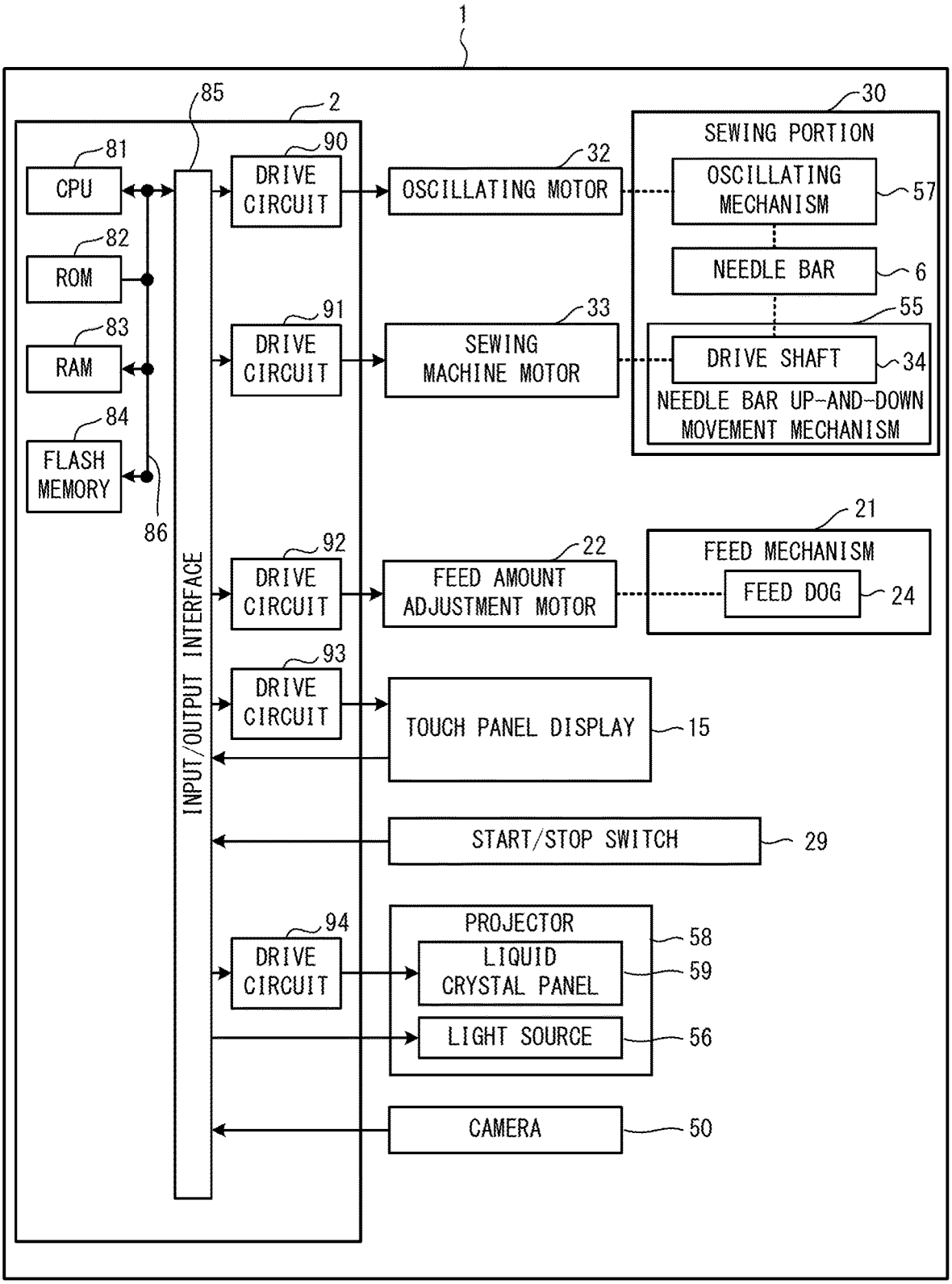
FIG. 3 is a block diagram of an electrical configuration of the sewing machine.

The needle bar up-and-down movement mechanism 55 includes a drive shaft 34 (refer to FIG. 3). The drive shaft 34 is provided inside the arm 13 (refer to FIG. 1) and extends in the left-right direction. The drive shaft 34 is rotated by the driving of a sewing machine motor 33 (refer to FIG. 3). The needle bar up-and-down movement mechanism 55 drives the needle bar 6 in the up-down direction by the rotation of the drive shaft 34. The oscillating mechanism 57 causes the needle bar 6 to oscillate in the left-right direction by the driving of an oscillating motor 32 (refer to FIG. 3).

In the following description, a position (point) on the cloth C when the sewing needle 7 pierces the cloth C as a result of the needle bar 6 being moved downward by the needle bar up-and-down movement mechanism 55 will be referred to as a "needle drop position." A plurality of the needle drop positions are present on the cloth C, as a result of the sewing needle 7 moving with respect to the cloth C. The needle drop positions include the needle drop positions when the sewing needle 7 has already pierced the cloth C, and the needle drop positions at which the sewing needle 7 is planned to pierce the cloth C. Of the needle drop positions, in particular, an intersection between the cloth C and a virtual line V extending downward from the sewing needle 7 will also be referred to as a "current needle drop position P."

The presser bar 8 is provided to the rear of the needle bar 6, and extends downward from the head portion 14. A presser foot 9 is detachably mounted to the lower end of the presser bar 8. The presser foot 9 extends downward from the presser bar 8. The presser bar 8 moves the presser foot 9 up and down by moving in the up-down direction between a lowered position and a raised position. When the presser bar 8 is positioned at the lowered position, the presser foot 9 presses the cloth C. When the presser bar 8 is positioned at the raised position, the presser foot 9 is separated upward from the cloth C. The presser foot 9 moves up and down in concert with the needle bar 6, and intermittently presses the cloth C downward against the upper surface of the bed 11.

The projector 58 is provided with a housing 53, a liquid crystal panel 59 (refer to FIG. 3), and a light source 56 (refer to FIG. 3). The housing 53 is fixed inside the head portion 14. The light source 56 is an LED, and is housed inside the housing 53. The liquid crystal panel 59 modulates light from the light source 56, and forms image light on the basis of image data. The projector 58 projects an image toward the bed 11, using the image light formed by the liquid crystal panel 59.

Hereinafter, the image projected by the projector 58 will be referred to as a "projection image," and a region on which the projector 58 projects the projection image will be referred to as a "projection region RC." The projection image is configured by a plurality of colors. The projection region RC has a rectangular shape, and is formed on the bed 11 or is formed on the cloth C on the bed 11. The projection region RC includes the current needle drop position P.

A sewing operation by the sewing machine 1 will be described. The sewing machine 1 performs the sewing operation on the basis of the sewing data. The sewing machine 1 feeds the cloth C in the front-rear direction with respect to the needle bar 6, using the feed dog 24 by driving the feed mechanism 21 (refer to FIG. 3). By driving the oscillating mechanism 57 (refer to FIG. 3), the sewing machine 1 changes a position, in the left-right direction, of the needle bar 6, or by driving the feed mechanism 21, feeds the cloth C in the left-right direction with respect to the needle bar 6.

The sewing machine 1 drives the sewing portion 30 while moving the cloth C in the front-rear direction or in the left-right direction relative to the needle bar 6. The sewing machine 1 moves the needle bar 6 up and down using the needle bar up-and-down movement mechanism 55, by driving the sewing portion 30. The sewing machine 1 forms the stitches on the cloth C as a result of the sewing needle 7 dropping in an order of the plurality of needle drop positions in the cloth C due to the up and down movement of the needle bar 6. In this way, the sewing machine 1 sews the sewing pattern on the cloth C placed on the bed 11. Hereinafter, the order of the needle drop positions at which the sewing needle 7 drops in the cloth C will be referred to as a "needle drop order."

A feed amount of the cloth C will be defined. The feed amount indicates an extent of progress of the sewing. For example, the feed amount corresponds to a number of stitches (a number of needle drops), to a movement amount of the cloth C, or to a number of rotations of the drive shaft 34. The number of stitches is the number of times the sewing needle 7 has dropped at the needle drop position, that is, is the number of times the sewing needle 7 has reciprocated in the up-down direction. The movement amount of the cloth C is an amount by which the cloth C moves relative to the needle bar 6 in the front-rear direction or the left-right direction, during a period in which the sewing needle 7 drops at the plurality of needle drop positions in the cloth C. The number of rotations of the drive shaft 34 corresponds to a number of rotations of the sewing machine motor 33.

The electrical configuration of the sewing machine 1 will be described with reference to FIG. 3. The sewing machine 1 is provided with a control portion 2. The control portion 2 is provided with a CPU 81, a ROM 82, a RAM 83, a flash memory 84, and an input/output interface (I/O) 85. The CPU 81 is connected to the ROM 82, the RAM 83, the flash memory 84, and the input/output I/O 85 via a bus 86.

The CPU 81 performs main control of the sewing machine 1 and functions as a processor. The ROM 82 stores various programs for controlling the operation of the sewing machine 1, and information and the like necessary for the CPU 81 when executing the various programs. An example of the various programs is a control program for executing main processing (refer to FIG. 4) to be described later. The RAM 83 temporarily stores calculation results and the like when executing the various programs.

The flash memory 84 is non-volatile, and stores a projection coordinate system, a world coordinate system, various parameters, the sewing data, and the like. The projection coordinate system is a coordinate system of the projector 58. The world coordinate system is a coordinate system of space as a whole. The various parameters are used by the CPU 81 for executing the processing, and include conversion parameters, for example. The conversion parameters cause the projection coordinate system and the world coordinate system to correspond to each other. Using the conversion parameters, the CPU 81 can identify coordinates of the projection coordinate system on the basis of coordinates of the world coordinate system. The sewing data represents, using the world coordinate system, the needle drop positions corresponding to the sewing pattern.

Drive circuits 90, 91, 92, 93, and 94, the touch panel display 15, the start/stop switch 29, the light source 56, and a camera 50 are connected to the input/output I/O 85. The light source 56 is illuminated on the basis of a control signal from the CPU 81. The camera 50 is, for example, an image sensor, and is provided at the head portion 14. The camera 50 captures an image of the cloth C on the bed 11. An image capture range by the camera 50 overlaps partially or totally with the projection region RC, and includes the current needle drop position P, for example. Hereinafter, the image captured by the camera 50 will be referred to as a "captured image."

The oscillating motor 32 is connected to the drive circuit 90. The drive circuit 90 drives the oscillating motor 32 on the basis of a control signal from the CPU 81. The sewing machine motor 33 is connected to the drive circuit 91. The drive circuit 91 drives the sewing machine motor 33 on the basis of a control signal from the CPU 81. The feed amount adjustment motor 22 is connected to the drive circuit 92. The drive circuit 92 drives the feed amount adjustment motor 22 on the basis of a control signal from the CPU 81.

The touch panel display 15 is connected to the drive circuit 93. The drive circuit 93 causes the touch panel display 15 to display the image on the basis of a control signal from the CPU 81. The liquid crystal panel 59 is connected to the drive circuit 94. The drive circuit 94 causes the liquid crystal panel 59 to form the image light on the basis of a control signal from the CPU 81.

The main processing will be described with reference to FIG. 4. When the power supply to the sewing machine 1 is turned on, the CPU 81 performs the main processing by reading out and operating the control program from the ROM 82. In the main processing, the CPU 81 performs control of the sewing operation, control of the generation and projection of the image, and the like. More specifically, in the main processing, the CPU 81 generates a generated image, to be described later, each time the sewing progresses by a number of stitches n, and causes the projector 58 to project the generated image. n is a natural number. In the processing to be described below, the CPU 81 stores various data that has been acquired, identified, generated, and the like, in the RAM 83.

The CPU 81 performs sewing pattern selection processing (step S11). In the processing at step S11, the CPU 81 displays, on the touch panel display 15, a screen (not shown in the drawings) for selecting the sewing pattern. The user selects the sewing pattern by the panel operation. The CPU 81 stores the sewing pattern selected by the user in the RAM 83. Hereinafter, a case will be described as an example where appropriate, in which the user has selected a zigzag-shaped sewing pattern (refer to FIG. 6).

The CPU 81 performs sewing speed setting processing (step S12). In the processing at step S12, the CPU 81 displays, on the touch panel display 15 (refer to FIG. 1), a screen (not shown in the drawings) for setting the sewing speed. The user sets the sewing speed by a panel operation. The CPU 81 stores the sewing speed set by the user in the RAM 83. The sewing speed is the number of stitches per unit time.

The CPU 81 sets the value of n in accordance with the sewing speed (step S13). n indicates the number of stitches at step S31 to be described later. For example, the flash memory 84 stores an n value setting table (not shown in the drawings). The n value setting table establishes the value of n in accordance with the sewing speed. In the present embodiment, the n value setting table establishes the value of n such that the value of n becomes larger the higher the sewing speed. The CPU 81 refers to the n value setting table and stores the value of n corresponding to the sewing speed set at step S12, in the RAM 83. Hereinafter, a case will be described as an example where appropriate, in which the CPU 81 has set "1" as the value of n.

The CPU 81 determines whether or not the operation of the start/stop switch 29 (refer to FIG. 1) for starting the operation of the sewing machine 1 has been performed by the user (step S14). When the operation for starting the operation of the sewing machine 1 has not been performed (no at step S14), the CPU 81 returns the processing to the processing at step S14. When the operation for starting the operation of the sewing machine 1 has been performed (yes at step S14), the CPU 81 acquires, from the flash memory 84, the sewing data corresponding to the sewing pattern selected by the processing at step S11 (step S15). The CPU 81 performs feed amount acquisition processing (refer to FIG. 5) (step S21).

The feed amount acquisition processing will be described with reference to FIG. 5. The CPU 81 identifies the feed amount on the basis of the sewing data (step S41). In the processing at step S41, the CPU 81 identifies the feed amount by calculating, on the basis of the coordinates of each of the needle drop positions, a distance and direction (vector) between the current needle drop position P and the stitch preceding the current needle drop position P by n stitches (one stitch preceding, for example). Note that the feed amount of the first stitch is "0." The sewing data may include the feed amount. In this case, in the processing at step S41, the CPU 81 identifies the feed amount from the sewing data without performing the calculation. The CPU 81 returns the processing to the main processing (refer to FIG. 4).

Figure 4:
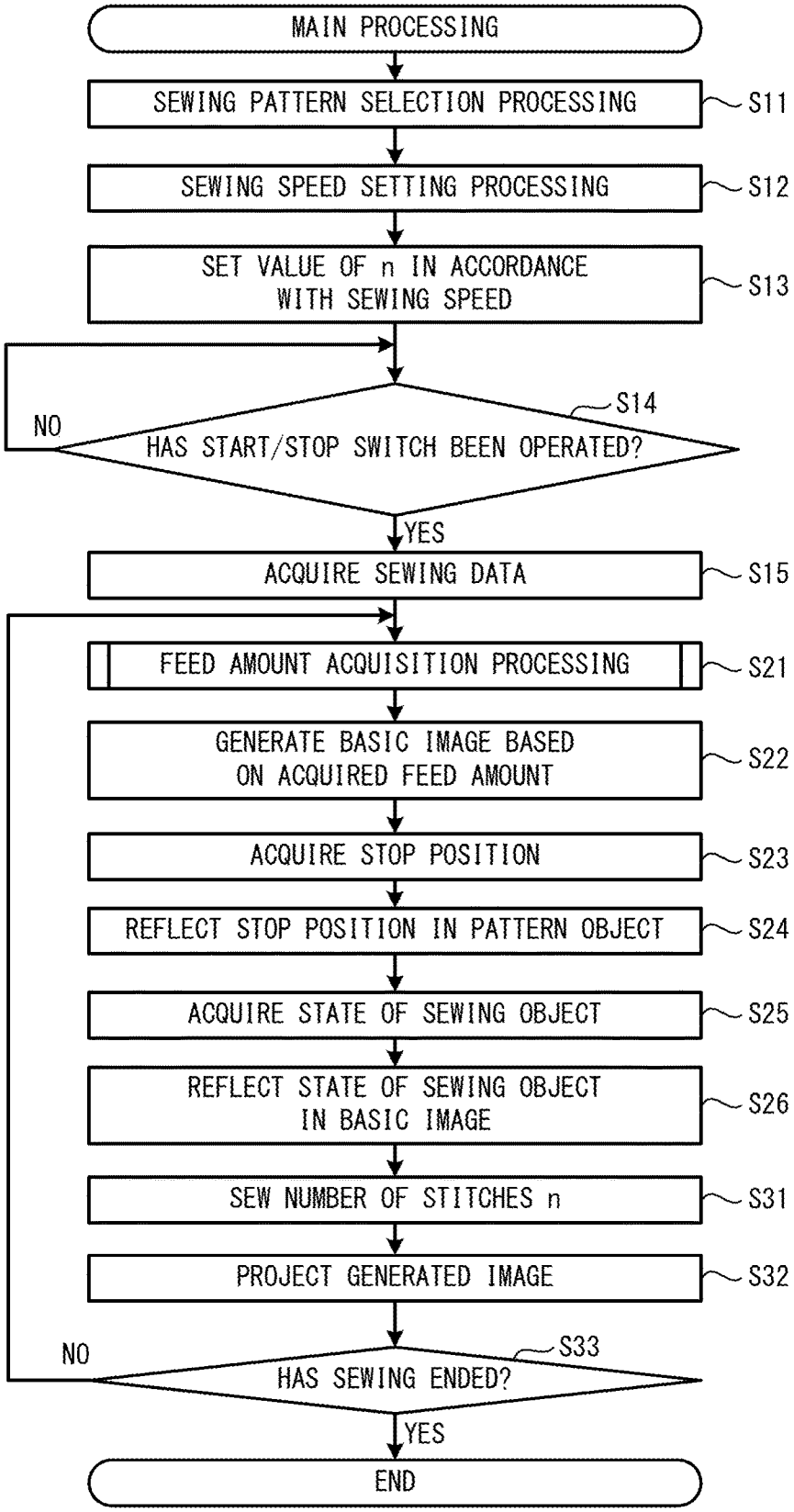
FIG. 4 is a flowchart of main processing.

As shown in FIG. 4, on the basis of the feed amount acquired by the processing at step S21, the CPU 81 generates the image to be projected onto the projection region RC (step S22). The CPU 81 repeats the processing at step S22 each time the sewing is performed for number of stitches n, until the sewing ends. Hereinafter, the image generated by the CPU 81 in the (P)-th processing at step S22 will be referred to as a "first basic image," and the image generated by the CPU 81 in the (P+1)-th processing at step S22 will be referred to as a "second basic image." When the first basic image and the second basic image are collectively referred to, or when no particular distinction is made therebetween, they will be referred to as a "basic image."

An overview of the first basic image and the second basic image will be described. The first basic image includes a first pattern object. The first pattern object represents a first sewing pattern. The first sewing pattern is at least a part of the sewing pattern selected by the processing at step S11, and represents a state in which the sewing is incomplete. In the present embodiment, taking one of the plurality of needle drop positions as an origin point, the first pattern object represents, as the first sewing pattern, one or a plurality of the needle drop positions that come after the origin point in the needle drop order, in order from the origin point.

The second basic image includes a second pattern object. The second pattern object represents a second sewing pattern. The second sewing pattern is at least a part of the sewing pattern selected by the processing at step S11, and represents a state in which the sewing has progressed more than in the first sewing pattern. Taking one of the plurality of needle drop positions as an origin point, the second pattern object represents, as the second sewing pattern, one or a plurality of the needle drop positions that come after the origin point in the needle drop order, in order from the origin point. Hereinafter, when the first pattern object and the second pattern object are collectively referred to, or when no particular distinction is made therebetween, they will be referred to as a "pattern object."

The first basic image includes a first guide object. The second basic image includes a second guide object. The first guide object and the second guide object respectively indicate a reference position for positioning the cloth C. The user places the cloth C on the bed 11 using the first guide object or the second guide object as a reference.

In the present embodiment, the shape of the first guide object and the shape of the second guide object are the same as each other. The position of the first guide object with respect to the first basic image and the position of the second guide object with respect to the second basic image are the same as each other. Hereinafter, when the first guide object and the second guide object are collectively referred to, or when no particular distinction is made therebetween, they will be referred to as a "guide object."

Figure 6:
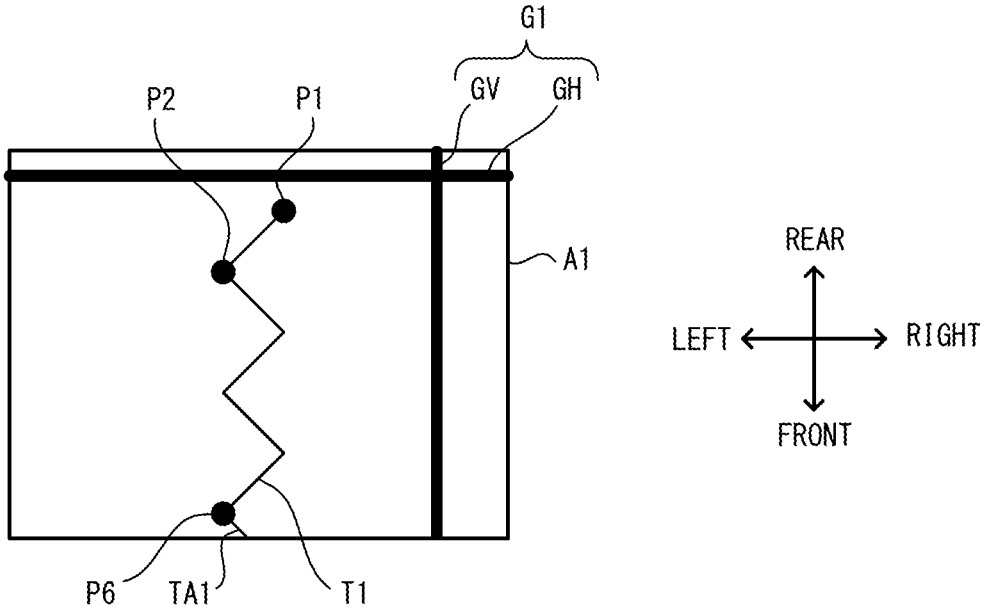
FIG. 6 is an explanatory diagram of a first basic image.

A first basic image A1 will be described with reference to FIG. 6, as an example of the first basic image. The upper side, the lower side, the left side, and the right side in FIG. 6 respectively correspond to the rear side, the front side, the left side, and the right side of the sewing machine 1 and correspond to the rear side, the front side, the left side, and right side of the image (the same applies to FIG. 7 to FIG. 9). The first basic image A1 represents the first basic image when the feed amount is "0," that is, the first basic image in the first (P=1) processing at step S22.

The first basic image A1 includes a first pattern object T1 and a first guide object G1. The first pattern object T1 has a zigzag shape, and extends to the front from a point P1 via points P2 and P6. The first pattern object T1 includes a partial pattern object TA1. The partial pattern object TA1 extends further to the front than the point P6, of the first pattern object T1.

The point P1 is the origin point of the first sewing pattern, and indicates the current needle drop position P (at the start of the sewing). The point P2 indicates the needle drop position when the sewing has progressed by one stitch from the point P1. The point P6 indicates the needle drop position when the sewing has progressed by six stitches from the point P1. In other words, the first pattern object T1 represents, as the first sewing pattern, the plurality of needle drop positions that come after the origin point in the needle drop order, in order from the origin point, when taking the current needle drop position P of the plurality of needle drop positions as the origin point.

The first guide object G1 is configured by guide lines, and includes a horizontal line GH and a vertical line GV. The horizontal line GH passes through a point separated, to the rear, from the point P1 by a first predetermined distance, and extends in the left-right direction. The first predetermined distance is not particularly limited, but in the present embodiment, corresponds to a size of a seam allowance, in the front-rear direction, of the cloth C. The vertical line GV passes through a point separated, to the right, from the point P1 by a second predetermined distance, and extends in the front-rear direction. The second predetermined distance is not particularly limited, but in the present embodiment, corresponds to the size of the seam allowance, in the left-right direction, of the cloth C.

Figure 7:
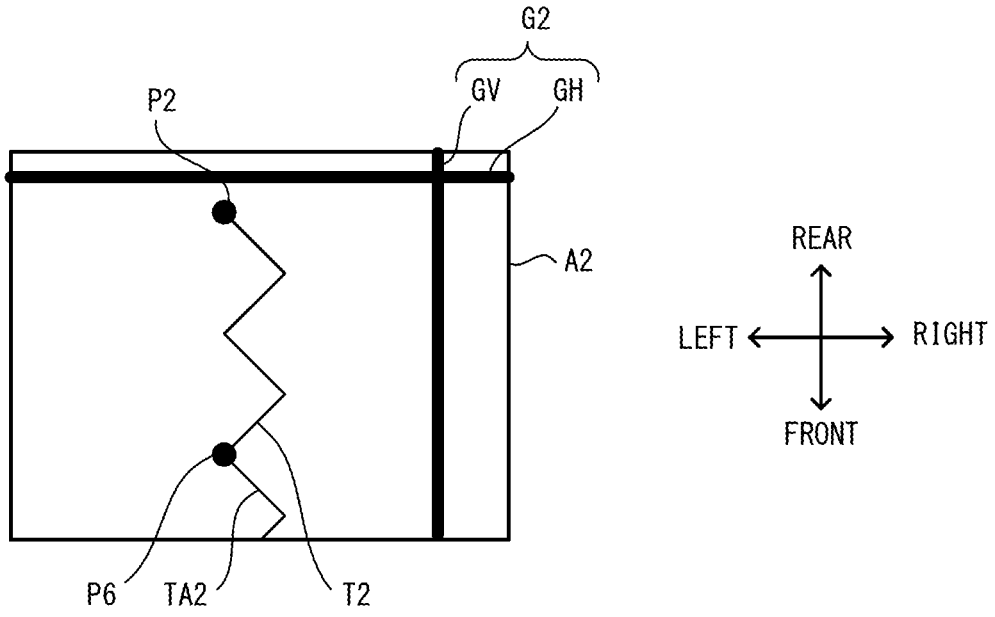
FIG. 7 is an explanatory diagram of a second basic image.

A second basic image A2 will be described with reference to FIG. 7, as an example of the second basic image. The second basic image A2 represents the second basic image in the second (P=2) processing at step S22. In other words, the second basic image A2 represents the sewing pattern in which the sewing has progressed by n stitches (n=1, for example) from the first processing at step S22, as the feed amount. Thus, the second basic image A2 represents the sewing pattern at a time point at which the sewing has progressed from the point P1 to the point P2.

The second basic image A2 includes a second pattern object T2 and a second guide object G2. The second pattern object T2 has a zigzag shape, and extends to the front from the point P2 via the point P6. The second pattern object T2 includes a partial pattern object TA2. The partial pattern object TA2 extends further to the front than the point P6, of the second pattern object T2.

The point P2 is the origin point of the second sewing pattern, and indicates the current needle drop position P (at the time point at which the sewing has progressed by n stitches from the start of the sewing). The point P6 indicates the needle drop position when the sewing has progressed by five stitches from the point P2. In other words, the second pattern object T2 represents, as the second sewing pattern, the plurality of needle drop positions that come after the origin point in the needle drop order, in order from the origin point, when taking the current needle drop position P of the plurality of needle drop positions as the origin point.

The shape of the second guide object G2 is the same as the shape of the first guide object G1, and includes the horizontal line GH and the vertical line GV. The position of the second guide object G2 with respect to the second basic image A2 is the same as the position of the first guide object G1 with respect to the first basic image A1.

As shown in FIG. 4, the CPU 81 acquires a stop position of the sewing (step S23). The stop position indicates a position of the end of the sewing in the front-rear direction. For example, the user attaches a marker M (refer to FIG. 10) at the position of the end of the sewing in the front-rear direction, on the cloth C. In the processing at step S23, the CPU 81 acquires the captured image from the camera 50 (refer to FIG. 3). On the basis of the acquired captured image, the CPU 81 identifies the position of the marker M in the front-rear direction as the stop position.

The CPU 81 reflects the stop position acquired by the processing at step S23 in the pattern object (step S24). In the processing at step S24, the CPU 81 corrects an end point of the pattern object such that the pattern object represents the practical pattern in which the unit pattern is repeated up to the stop position. In other words, the CPU 81 causes the position of the end point of the pattern object to be aligned with the stop position, in the front-rear direction.

Figure 8:
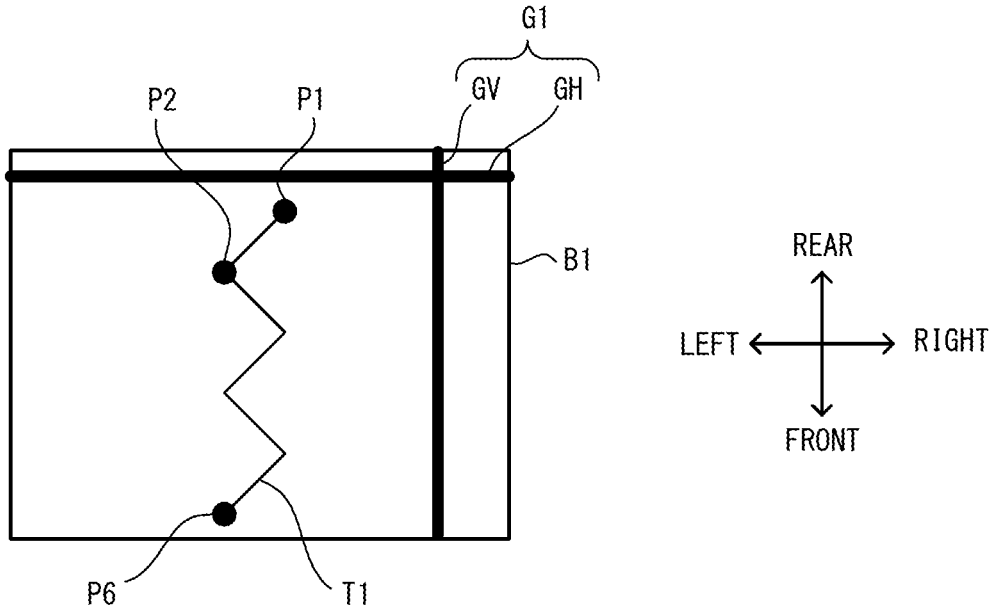
FIG. 8 is an explanatory diagram of a first corrected image.

An example in which the stop position is reflected in the first basic image A1 will be described with reference to FIG. 8. The CPU 81 generates a first corrected image B1 by reflecting the stop position in the first basic image A1 (refer to FIG. 6). More specifically, the CPU 81 identifies the point P6 as the point whose position is aligned with the stop position (the marker M) in the front-rear direction. The CPU 81 excludes the needle drop positions further to the front than the point P6 in the first basic image A1, that is, excludes the partial pattern object TA1 from the first basic image A1. In this way, the CPU 81 causes the point P6 to be the end point of the first pattern object T1, and causes the position of the end point of the first pattern object T1 to be aligned with the stop position in the front-rear direction. In this way, the CPU 81 generates the first corrected image B1.

Figure 9:
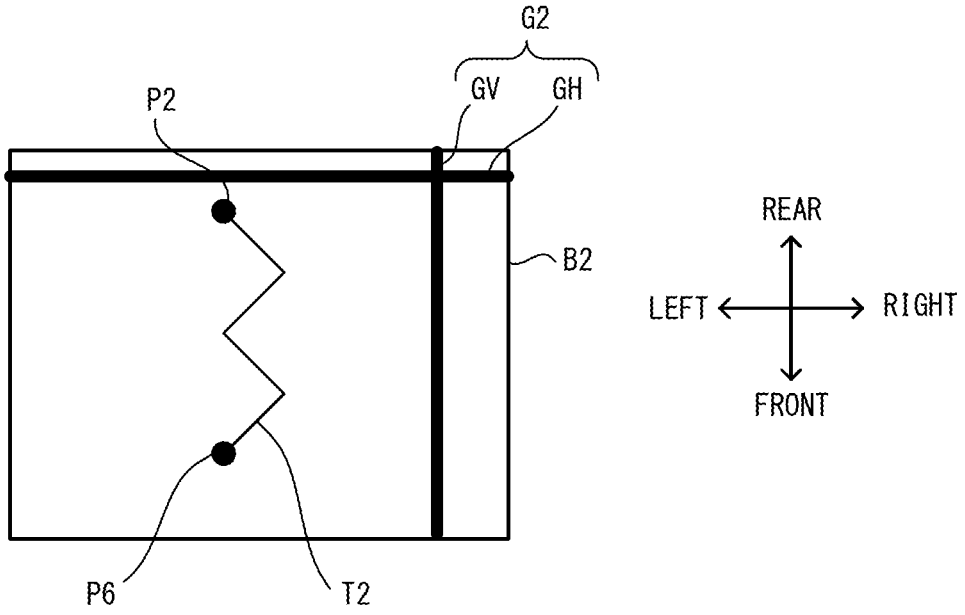
FIG. 9 is an explanatory diagram of a second corrected image.

An example in which the stop position is reflected in the second basic image A2 will be described with reference to FIG. 9. The CPU 81 generates a second corrected image B2 by reflecting the stop position in the second basic image A2 (refer to FIG. 7). More specifically, the CPU 81 identifies the point P6 as the point whose position is aligned with the stop position (the marker M) in the front-rear direction. The CPU 81 excludes the needle drop positions further to the front than the point P6 in the second basic image A2, that is, excludes the partial pattern object TA2 from the second basic image A2. In this way, the CPU 81 causes the point P6 to be the end point of the second pattern object T2, and causes the position of the end point of the second pattern object T2 to be aligned with the stop position in the front-rear direction. In this way, the CPU 81 generates the second corrected image B2.

In the first basic image A1 (refer to FIG. 8) and the second basic image A2 (refer to FIG. 9), when, for example, the sewing pattern is the practical pattern and the unit patterns extend from the rear toward the front, the "needle drop positions further to the front than the point P6" indicate one or a plurality of the needle drop positions that are later, in the sewing order, than the point whose position is aligned, in the front-rear direction, with the stop position.

As shown in FIG. 4, the CPU 81 acquires a state of the cloth C (step S25). In the processing at step S25, the CPU 81 acquires the captured image from the camera 50. On the basis of the acquired captured image, the CPU 81 identifies the state of the cloth C. The states of the cloth C include one or a plurality of states, from among positional displacement of the cloth C, puckering of the cloth C, displacement of stitches, and the like.

More specifically, the CPU 81 analyzes the captured image and extracts image features. The CPU 81 compares the image features extracted from the captured image by the processing at the current step S25 with the image features extracted from the captured image by the processing at the previous step S25, and identifies the state of the cloth C on the basis of the difference therebetween.

The CPU 81 reflects the state of the cloth C acquired by the processing at step S25 in the basic image (step S26). An example will be described in which the state of the cloth C is reflected in the basic image. For example, when it is identified in the processing at step S25 that the cloth C is in a rotated state in a plan view, the CPU 81 corrects the basic image in accordance with a rotation direction of the cloth C. In this case, the CPU 81 may rotate the whole of the basic image, or may rotate only a specific object in the basic image. For example, the CPU 81 may rotate only the pattern object, of the pattern object and the guide object in the basic image. In other words, in the processing at step S26, the CPU 81 may reflect the state of the cloth C in the whole of the basic image, or may reflect the state of the cloth C in only the specific object (the pattern object, for example) of the basic image.

When, for example, it is identified by the processing at step S25 that puckering of the cloth C has occurred in the front-rear direction, the CPU 81 corrects the basic image in accordance with an amount of the puckering of the cloth C in the front-rear direction. In this case, in the second pattern object, for example, the CPU 81 takes the current needle drop position P as a reference and performs parallel translation of the other needle drop positions in the front-rear direction, such that a distance in the front-rear direction between the plurality of needle drop positions becomes smaller by an amount corresponding to the puckering of the cloth C in the front-rear direction.

Hereinafter, an image generated as a result of the CPU 81 correcting the first basic image by the processing at step S24 and the processing at step S26 will be referred to as a "first generated image," and an image generated as a result of the CPU 81 correcting the second basic image by the processing at step S24 and the processing at step S26 will be referred to as a "second generated image." The first generated image and the second generated image are both rectangular, and are the same size as each other.

When the first generated image and the second generated image are collectively referred to, or when no particular distinction is made therebetween, they will be referred to as a "generated image." The generated image also includes the basic image when the CPU 81 has not performed the correction at either one or both of the processing at step S24 and the processing at step S26, that is, includes the basic image as it is, for example. Hereinafter, a case will be described as an example as appropriate, in which the first corrected image B1 is an example of the first generated image, and the second corrected image B2 is an example of the second generated image.

The CPU 81 controls the sewing of the number of stitches n for a portion that is not yet sewn, of the sewing data acquired by the processing at step S15 (step S31). The value of n is the value set by the CPU 81 in the processing at step S13, and is "1," for example. In the processing at step S31, the CPU 81 controls the oscillating motor 32 and the feed amount adjustment motor 22, and also controls the sewing machine motor 33 to operate at the sewing speed set by the processing at step S12 (refer to FIG. 3). In this way, the sewing machine 1 forms the number of stitches n on the cloth C. For example, the sewing machine 1 forms a stitch ST (refer to FIG. 11) from the point P1 to the point P2 on the cloth C.

The CPU 81 causes the projector 58 (refer to FIG. 1) to project the generated image (step S32). The projector 58 projects the generated image onto the projection region RC. The CPU 81 repeats the processing at step S32 for each of the sewing for the number of stitches n, until the sewing ends. In other words, the CPU 81 causes the projector 58 to project the first generated image in the (P)-th processing at step S32. When the sewing has progressed by the number of stitches n, the CPU 81 performs the (P+1)-th processing at step S32. In the (P+1)-th processing at step S32, the CPU 81 switches the first generated image that is being projected to the second generated image, during the sewing, and causes the projector 58 to project the second generated image.

Figure 10:
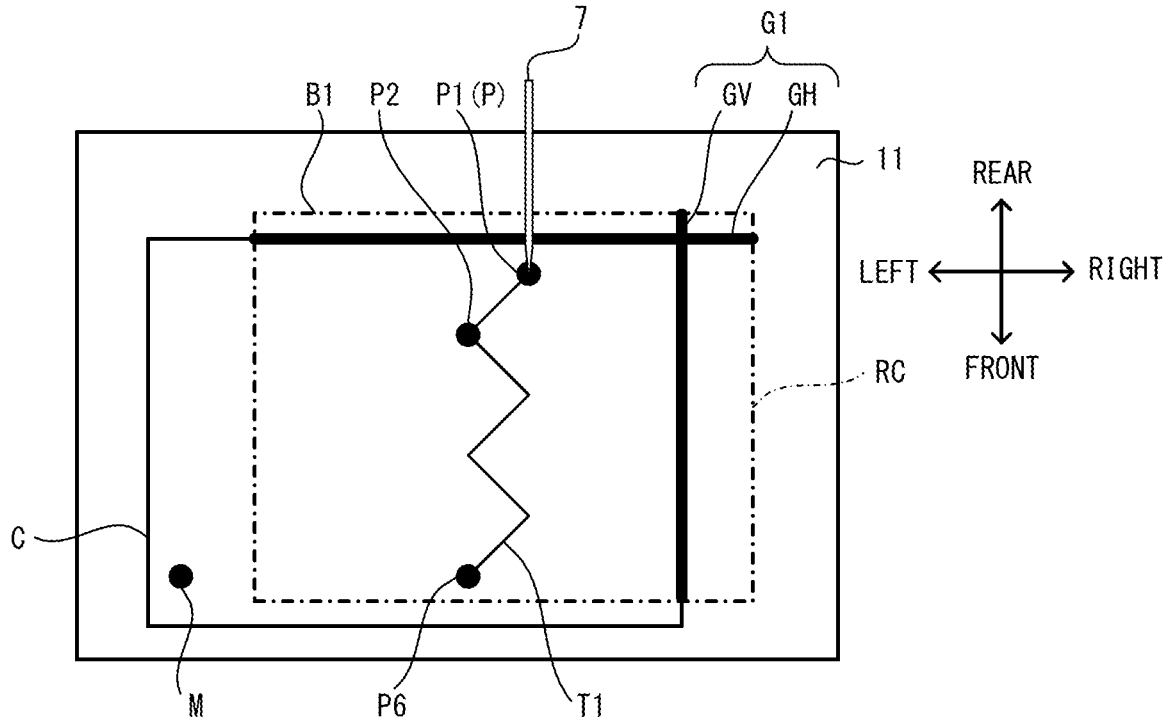
FIG. 10 is a plan view of a bed when a projector projects the first corrected image onto a projection region.

With reference to FIG. 10, a case will be described in which, at the (P)-th processing at step S32, the CPU 81 causes the projector 58 to project the first corrected image B1 as the first generated image. In this case, the projector 58 projects the first corrected image B1 onto the projection region RC. On the cloth C, the first pattern object T1 extends in the front-rear direction from the current needle drop position P (the point P1) to the marker M (the point P6). Thus, the user can visually check that the unsewn sewing pattern remains from the point P1 to the point P6.

Figure 11:
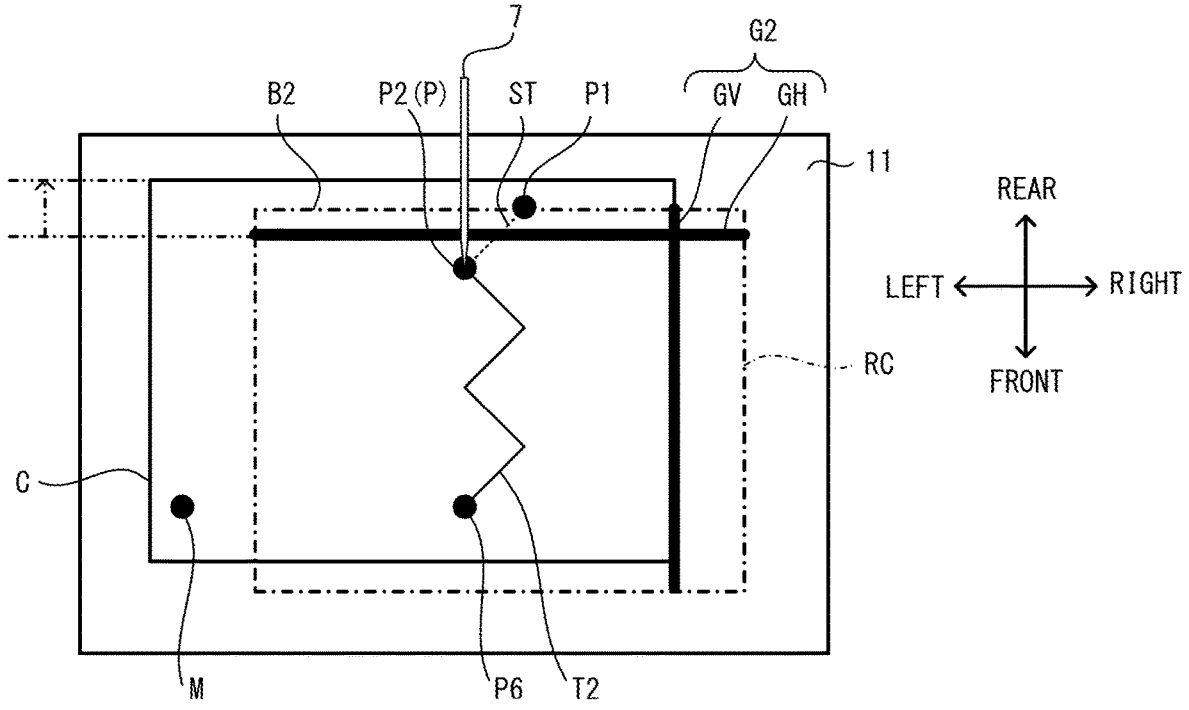
FIG. 11 is a plan view of the bed when the projector projects the second corrected image onto the projection region.

With reference to FIG. 11, a case will be described in which, at the (P+1)-th processing at step S32, the CPU 81 causes the projector 58 to project the second corrected image B2 as the second generated image. The projector 58 projects the second generated image onto the projection region RC. In this case, on the cloth C, the second pattern object T2 extends in the front-rear direction from the current needle drop position P (the point P2) to the marker M (the point P6). Thus, the user can visually check that the stitch ST has been formed from the point P1 to the point P2, and that the unsewn sewing pattern remains from the point P2 to the point P6.

The CPU 81 determines whether or not the sewing based on the sewing data acquired by the processing at step S15 has ended (step S33). For example, when stitches that have not yet been formed are included among the stitches corresponding to the coordinates of the plurality of needle drop positions in the sewing data and there is an unsewn portion of the sewing data, the CPU 81 determines that the sewing has not ended (no at step S33). In this case, the CPU 81 returns the processing to the processing at step S21. In this way, the CPU 81 performs the processing at step S21 to step S32 for each of the number of stitches n. In other words, the CPU 81 generates the generated image and causes the projector 58 to project the generated image for each of the number of stitches n. For example, when all of the stitches corresponding to the coordinate of the plurality of needle drop positions in the sewing data have been formed and there is no unsewn portion in the sewing data, the CPU 81 determines that the sewing has ended (yes at step S33). In this case, the CPU 81 ends the main processing.

As described above, in the above-described embodiment, after causing the projector 58 to display the first generated image, the CPU 81 switches the first generated image that is being projected to the second generated image during the sewing, and causes the projector 58 to project the second generated image. The first generated image includes the first pattern object. The first pattern object represents the first sewing pattern. The second generated image includes the second pattern object. The second pattern object represents the second sewing pattern. The second sewing pattern is the pattern when the sewing has progressed more than in the first sewing pattern. Thus, by switching from the first generated image to the second generated image during the sewing, the sewing machine 1 contributes to the advantage of making it easier for the user to ascertain an extent of progress of the sewing.

When the sewing has progressed by the number of stitches n, the CPU 81 switches the first generated image that is being projected to the second generated image. According to this configuration, by switching the first generated image that is being projected to the second generated image, the sewing machine 1 contributes to the advantage of making it easier for the user to ascertain that the sewing has progressed by the number of stitches n.

The CPU 81 sets the value of n in accordance with the sewing speed. According to this configuration, the sewing machine 1 can control, in accordance with the sewing speed, a timing at which the first generated image that is being projected is switched to the second generated image. Furthermore, the higher the sewing speed, the larger the value of n. As a result, the sewing machine 1 contributes to the advantage of being able to suppress a timing of switching from the first generated image to the second generated image during the sewing from being too late when the sewing speed is high.

When the specific needle drop position is taken as the origin point, the second sewing pattern includes the plurality of needle drop positions that come after the origin point in the needle drop order, in order from the origin point. According to this configuration, by projecting the second generated image, the sewing machine 1 contributes to the advantage of making it easier for the user to ascertain the plurality of needle drop positions that come after the specific needle drop position in the needle drop order. Furthermore, the specific needle drop position is the current needle drop position P. When the sewing needle 7 has dropped at the specific needle drop position, the CPU 81 switches the first generated image that is being projected to the second generated image. Thus, the sewing machine 1 contributes to the advantage of being able match the timing of switching the first generated image that is being projected to the second generated image with the timing at which the sewing needle 7 has dropped at the specific needle drop position that is the origin point.

The camera 50 detects the state of the cloth C. On the basis of the captured image from the camera 50, the CPU 81 reflects the state of the cloth C in the second basic image. In this way, the CPU 81 generates the second generated image. According to this configuration, the sewing machine 1 contributes to the advantage of being able to generate the second generated image while taking into account the state of the cloth C.

The second pattern object represents the practical pattern in which the unit pattern is repeated up to the stop position. According to this configuration, the sewing machine 1 can align the end position of the practical pattern in the second sewing pattern with the stop position of the sewing. Thus, the sewing machine 1 contributes to the advantage of making it easier for the user to ascertain a timing at which the sewing machine 1 ends the sewing.

The guide object indicates the reference position for positioning the cloth C. The shape of the first guide object and the shape of the second guide object are the same as each other. The position of the first guide object with respect to the first generated image and the position of the second guide object with respect to the second generated image are the same as each other. According to this configuration, both during the projection of the first generated image and during the projection of the second generated image, the sewing machine 1 contributes to the advantage of making it easier, using the guide object, for the user to ascertain whether or not the cloth C has become displaced from the reference position.

The present disclosure can be changed from the above-described embodiment in various ways. Insofar as no contradictions arise, modified examples to be described below may be combined as appropriate. For example, in the processing at step S21 of the main processing (refer to FIG. 4), the CPU 81 may perform feed amount acquisition processing shown in FIG. 12 instead of the feed amount acquisition processing shown in FIG. 5, and the CPU 81 may perform main processing shown in FIG. 13 and FIG. 14 instead of the main processing shown in FIG. 4.

A modified example of the feed amount acquisition processing will be described with reference to FIG. 12. The feed amount acquisition processing shown in FIG. 12 differs from the feed amount acquisition processing shown in FIG. 5 in that the CPU 81 acquires the feed amount on the basis of the captured image.

The CPU 81 acquires the captured image from the camera 50 (step S51). The captured image includes image features for identifying the feed amount. The image feature includes one or a plurality of the stitches on the cloth C, the end portion of the cloth C, the marker M, and the like. The CPU 81 stores the acquired captured image in the RAM 83.

The CPU 81 extracts the image feature from the captured image acquired by the processing at step S51 (step S52). The RAM 83 stores a counter value k. An initial value of the counter value k, that is, a value of a sewing start point, is "0." The CPU 81 stores the image feature extracted by the processing at step S52 in association with the counter value k, in the RAM 83 (step S53). Hereinafter, the image feature corresponding to the counter value k will be referred to as a "(k)-th image feature."

The CPU 81 determines whether or not the counter value k is "0" (step S54). When the counter value k is "0" (yes at step S54), the CPU 81 returns the processing to the main processing (refer to FIG. 4). When the counter value k is "1" or more (no at step S54), the CPU 81 refers to the RAM 83 and calculates the feed amount on the basis of a difference between the (k)-th image feature and a (k−1)-th image feature (step S55).

In the processing at step S55, as the feed amount, the CPU 81 calculates a distance that the cloth C has actually moved, and a direction in which the cloth C has actually moved, during a period from extracting the (k−1)-th image feature to extracting the (k)-th image feature. The CPU 81 adds "1" to the counter value k (step S56). The CPU 81 returns the processing to the main processing (refer to FIG. 4).

A modified example of the main processing will be described with reference to FIG. 13 and FIG. 14. Hereinafter, in each of the steps of the main processing according to the modified example, for the processing that is the same as that of the main processing shown in FIG. 4, the same step number will be allocated to each of the same steps as those of the main processing shown in FIG. 4, and a description thereof will be omitted or simplified. The main processing shown in FIG. 13 and FIG. 14 differs from the main processing shown in FIG. 4 in that each time a predetermined time period elapses and a current number of stitches (j2) becomes greater than a number of stitches (j1) at the time of projection, the CPU 81 generates the generated image and causes the projector 58 to project the generated image.

Figure 13:
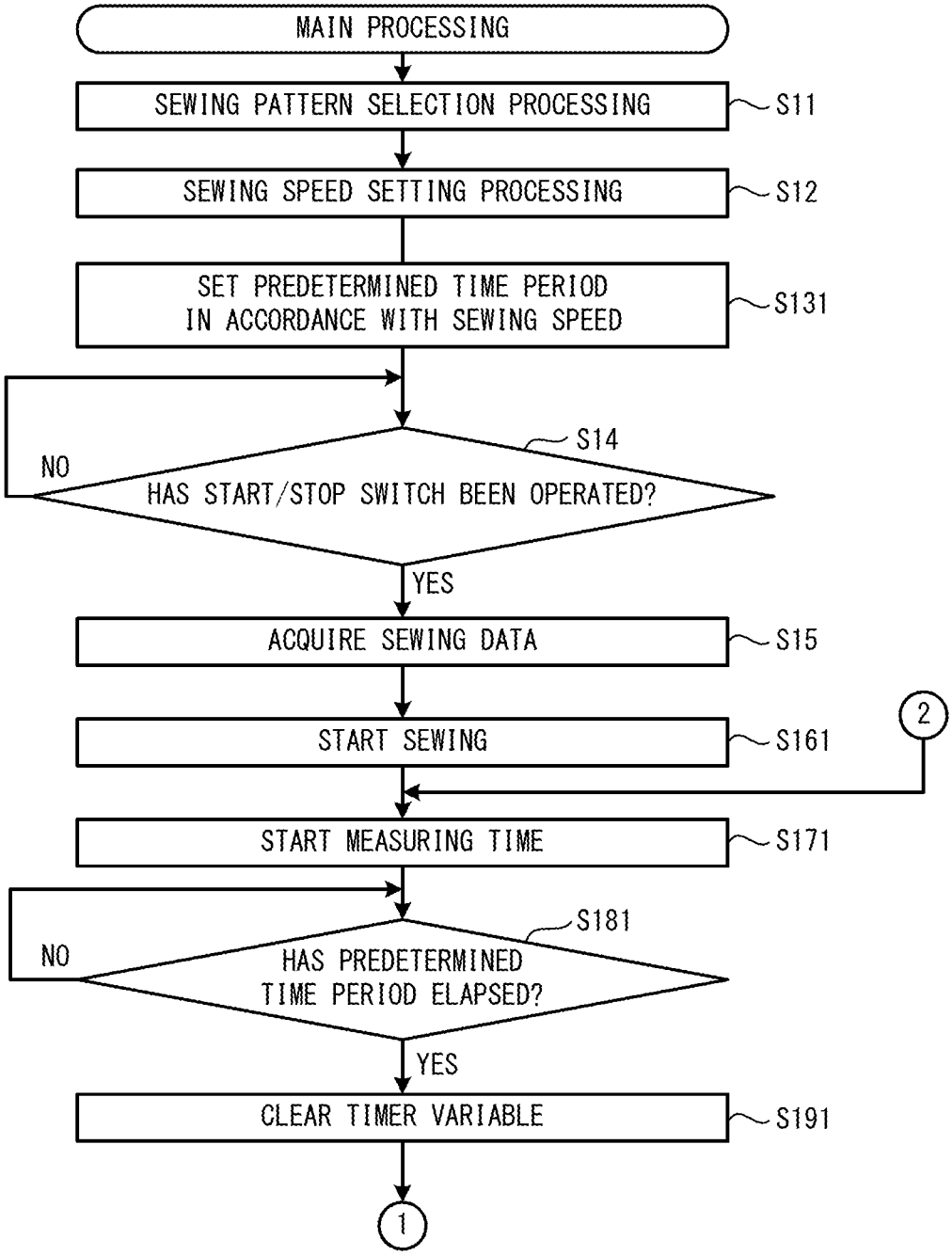
FIG. 13 is a flowchart of the main processing.

As shown in FIG. 13, after the processing at step S11 and step S12, the CPU 81 sets the predetermined time period in accordance with the sewing speed (step S131). The predetermined time period indicates a timing at which the first generated image that is being projected is switched to the second generated image. For example, the flash memory 84 stores a time period setting table (not shown in the drawings). The time period setting table establishes the length of the predetermined time period in accordance with the sewing speed. The time period setting table establishes the predetermined time period such that the higher the sewing speed the longer the predetermined time period. The CPU 81 refers to the time period setting table and stores, in the RAM 83, the predetermined time period corresponding to the sewing speed set by the processing at step S12.

After the processing at step S14 and step S15, the CPU 81 starts the sewing on the basis of the sewing data acquired by the processing at step S15 (step S161). In the processing at step S161, the CPU 81 controls the oscillating motor 32 and the feed amount adjustment motor 22, and controls the sewing machine motor 33 to operate at the sewing speed set by the processing at step S12. In this way, the sewing machine 1 forms the stitches on the cloth C and performs the sewing of the sewing pattern on the cloth C. The CPU 81 performs the processing from step S161 onward while controlling the sewing started by the processing at step S161.

The CPU 81 starts measuring time (step S171). For example, the RAM 83 stores a timer variable. In the processing at step S171, the CPU 81 starts measuring the time by starting an update of the timer variable. The CPU 81 may be connected to a timer (not shown in the drawings), and may measure the time using the timer.

The CPU 81 refers to the timer variable and determines whether or not the predetermined time period has elapsed from when the CPU 81 starts measuring the time by the processing at step S171 (step S181). When the predetermined time period has not elapsed (no at step S181), the CPU 81 returns the processing to step S181. When the predetermined time period has elapsed (yes at step S181), the CPU 81 clears the timer variable to an initial value in the RAM 83 (step S191). The CPU 81 advances the processing to the processing at step S21 (refer to FIG. 14). When the projection of the generated image by the projector 58 has not been performed for a first time, the CPU 81 may skip the processing at step S171, step S181, and step S191.

Figure 5:
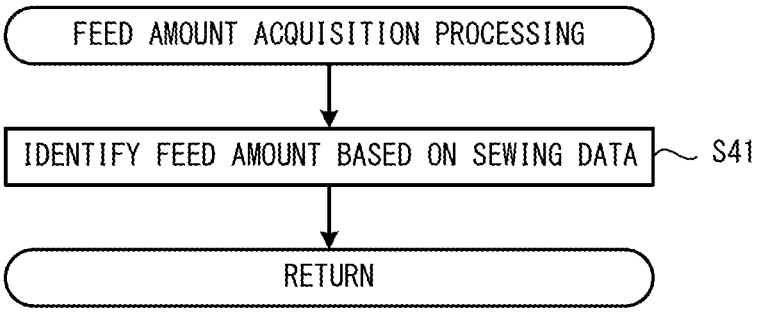
FIG. 5 is a flowchart of feed amount acquisition processing.
Figure 12:
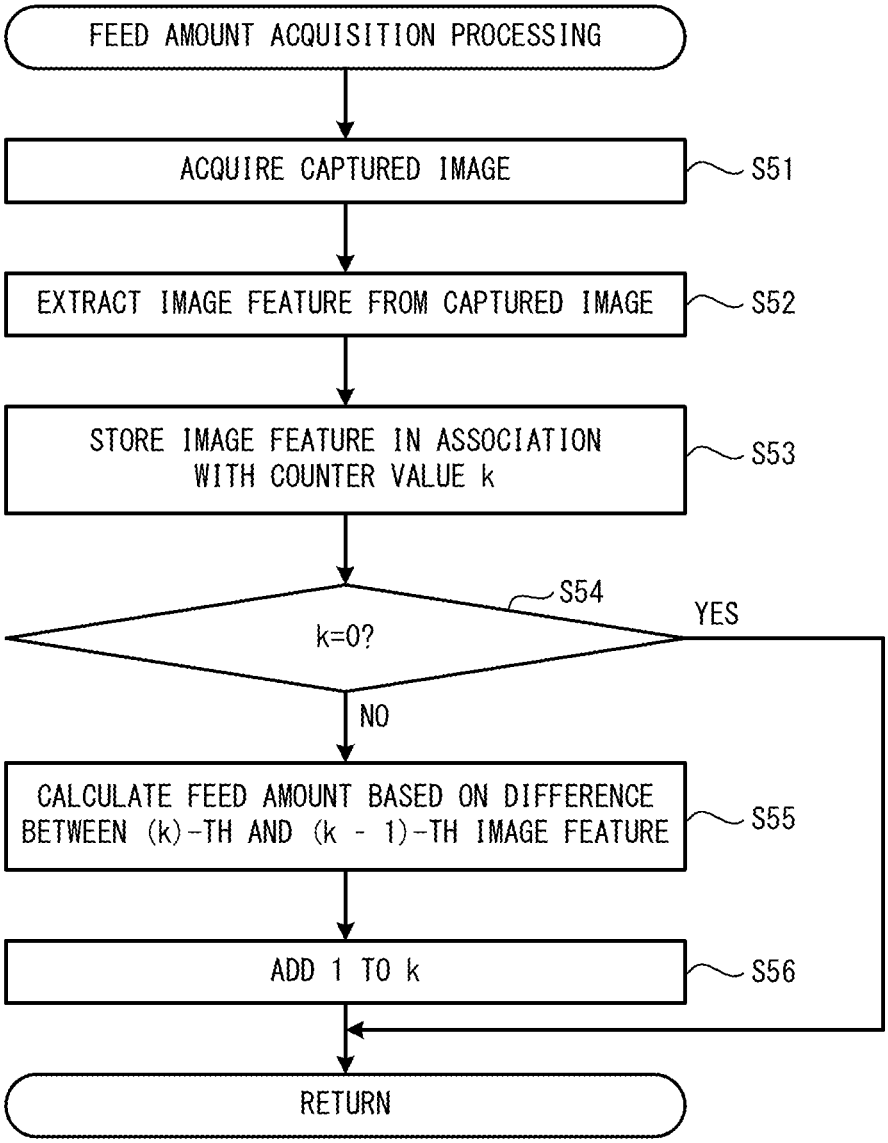
FIG. 12 is a flowchart of the feed amount acquisition processing.
Figure 14:
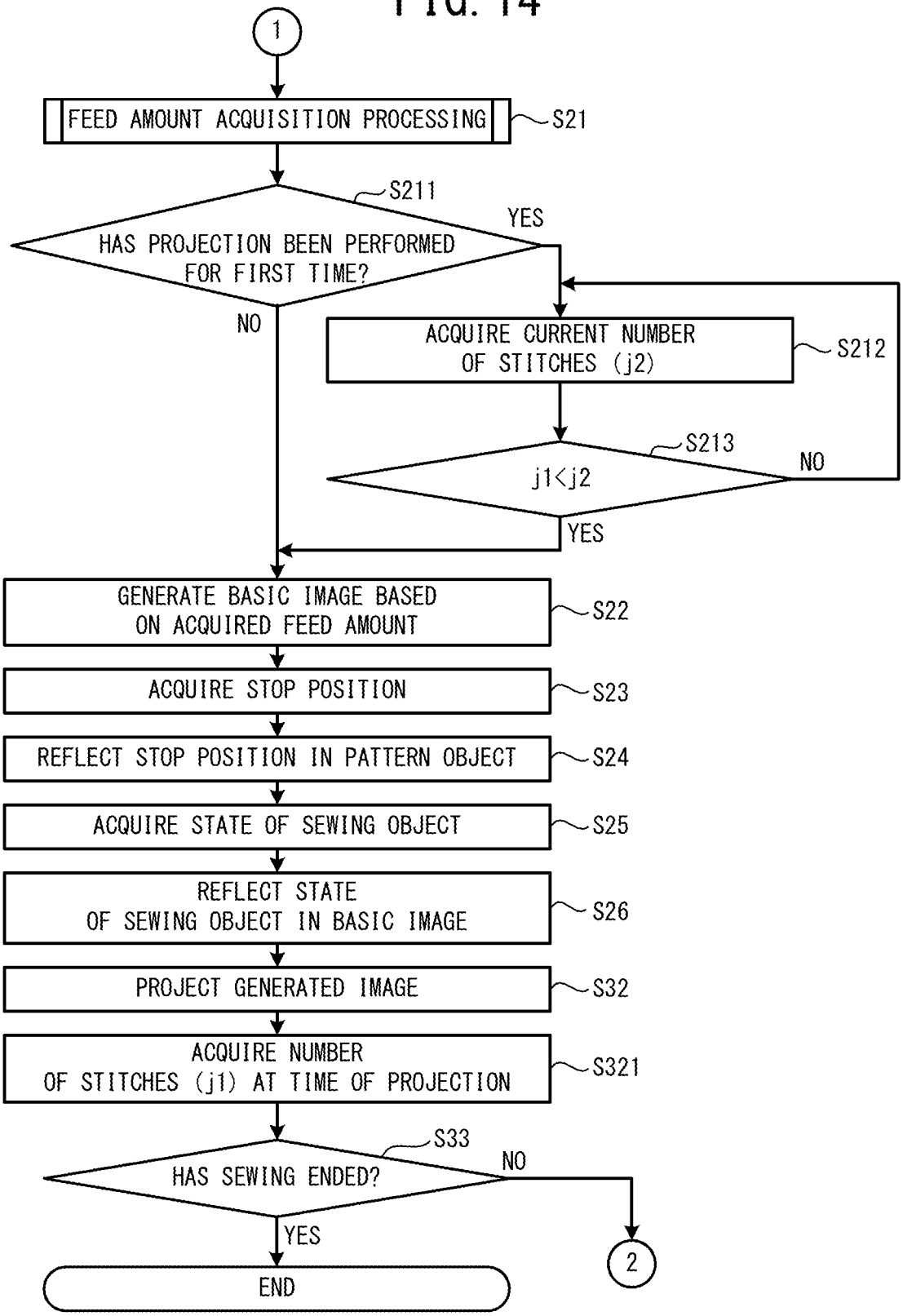
FIG. 14 is a flowchart of the main processing.

As shown in FIG. 14, the CPU 81 performs the feed amount acquisition processing shown in FIG. 5 or FIG. 12 (step S21). The CPU 81 determines whether or not the generated image has been projected by the projector 58 for the first time (step S211). For example, each time the CPU 81 causes the projector 58 to project the generated image by the processing at step S32, the CPU 81 stores the number of times the generated image has been projected at step S32 in the RAM 83. When the number of times the generated image has been projected at step S32 is zero, the CPU 81 determines that the projection for the first time has not been performed (no at step S211). In this case, the CPU 81 performs the processing at step S22, step S23, step S24, step S25, step S26, and step S32.

After the processing at step S32, the CPU 81 acquires the number of stitches (j1) at the time of projection (step S321). For example, each time the sewing of one stitch is complete, the CPU 81 stores the number of stitches in the RAM 83. The number of stitches (j1) at the time of projection indicates the number of stitches at the time point at which the CPU 81 causes the projector 58 to project the generated image in the processing at step S32. When the sewing has not ended (no at step S33), the CPU 81 returns the processing to step S171 (refer to FIG. 13).

In the processing at step S211, when a number of times that the generated image has been projected at step S32 is once or more, the CPU 81 determines that the projection for the first time has been performed (yes at step S211). In this case, the CPU 81 acquires a current number of stitches (j2) (step S212). The current number of stitches (j2) in the processing at step S212 indicates the number of stitches stored in the RAM 83 at the time point at which the CPU 81 performs the processing at step S212.

The CPU 81 acquires the number of stitches as the feed amount by the processing at step S212 and step S321, and switches the first generated image that is being projected to the second generated image, on the basis of the number of stitches acquired as the feed amount. More specifically, the CPU 81 determines whether or not the current number of stitches (j2) is greater than the number of stitches (j1) at the time of projection (step S213). When the current number of stitches (j2) is equal to or less than the number of stitches (j1) at the time of projection (no at step S213), the CPU 81 returns the processing to step S212. Each time the processing at step S212 is performed, the CPU 81 acquires, in the RAM 83, the number of stitches that increases as a result of the progress of the sewing by the sewing machine 1.

When the current number of stitches (j2) is greater than the number of stitches (j1) at the time of projection (yes step S213), the CPU 81 performs the processing at step S22, step S23, step S24, step S25, step S26, step S32, and step S321. The CPU 81 may omit the processing at step S211, step S212, and step S213. In other words, the CPU 81 may generate the generated image each time the predetermined time period elapses, and may cause the projector 58 to project the generated image. After the processing at step S321, when the sewing has ended (yes at step S33), the CPU 81 ends the main processing.

As described above, in the modified example of the main processing, the CPU 81 switches the first generated image that is being projected to the second generated image on the basis of the acquired feed amount. According to this configuration, since the feed amount is associated with the extent of progress of the sewing, the sewing machine 1 contributes to the advantage of being able to switch from the first generated image that is being projected to the second generated image at an appropriate timing.

When the measured time period exceeds the predetermined time period, the CPU 81 switches the first generated image that is being projected to the second generated image. In this case, by switching the first generated image that is being projected to the second generated image, the sewing machine 1 contributes to the advantage of making it easier for the user to ascertain that the sewing has progressed by an amount corresponding to the predetermined time period.

The CPU 81 sets the value of the predetermined time period in accordance with the sewing speed. According to this configuration, the sewing machine 1 can control the timing at which the first generated image that is being projected is switched to the second generated image in accordance with the sewing speed. Furthermore, the higher the sewing speed, the longer the predetermined time period. Thus, the sewing machine 1 contributes to the advantage of being able to suppress the switching from the first generated image to the second generated image during the sewing from being too late when the sewing speed is high.

In the modified example of the main processing, the CPU 81 may omit the processing at step S171, step S181, and step S191. In this case, in the processing at step S213, the CPU 81 may determine whether or not to advance the processing to the processing from step S22 onward, on the basis of the number of stitches (the number of needle drops), the movement amount of the cloth C, or the number of rotations of the drive shaft 34, as the feed amount. It is sufficient that the feed amount be a parameter that is associated with the extent of progress of the sewing.

The sewing machine 1 may be provided with a sensor, for example, for detecting the feed amount. The sensor is an encoder, an infrared sensor, or the like. The encoder may be provided on some or all of the oscillating motor 32, the sewing machine motor 33, and the feed amount adjustment motor 22, and may detect the number of rotations of the motor. The CPU 81 can identify the oscillation amount of the sewing needle 7, the number of stitches (the number of needle drops), the movement amount of the cloth C, and the like, on the basis of the number of rotations of the motors. The infrared sensor may be provided at the head portion 14, for example, and may detect the position of the cloth C. In the processing at step S212 and step S321, the CPU 81 may acquire a detection result from the encoder or the infrared sensor.

In the processing at step S213, the CPU 81 may identify the feed amount on the basis of the detection result, and may determine whether or not to advance the processing to the processing from step S22 onward, on the basis of the identified feed amount. In this case, if the identified feed amount has reached a specific feed amount, the CPU 81 generates the second generated image by the processing at step S22 to step S26, and causes the projector 58 to project the second generated image by the processing at step S32. According to this configuration, the sewing machine 1 can suppress the acquired feed amount of the cloth C from deviating from an actual feed amount of the cloth C. As a result, the sewing machine 1 contributes to the advantage of switching the first generated image that is being projected to the second generated image at the appropriate timing.

The CPU 81 may acquire the captured image from the camera 50 in the processing at step S212 and step S321. In the processing at step S213, the CPU 81 may compare the captured image acquired by the processing at step S212 with the captured image acquired by the processing at step S321, and may identify the feed amount. The sewing machine 1 may be provided with a plurality of cameras, such as the camera 50 for detecting the feed amount, the camera 50 for detecting the state of the cloth C, the camera 50 for detecting the marker M, and the like.

In the processing at step S213, the CPU 81 may determine whether or not to advance the processing to the processing from step S22 onward on the basis of the identified feed amount. According to this configuration, the sewing machine 1 can acquire the actual feed amount of the cloth C from the camera 50. As a result, the sewing machine 1 contributes to the advantage of being able to switch the first generated image that is being projected to the second generated image at a timing corresponding to the actual feed amount of the cloth C.

The time period setting table may establish the predetermined time period such that the higher the sewing speed, the shorter the predetermined time period. The CPU 81 may set the value of the predetermined time period in accordance with the sewing speed without referring to the time period setting table. The CPU 81 may set the predetermined time period to a predetermined value irrespective of the sewing speed. In this case, the value of the predetermined time period is not limited to a particular value. A configuration may be adopted in which the user can set the value of the predetermined time period.

Other modified examples will be described below. Hereinafter, one of the plurality of needle drop positions will be referred to as a "first needle drop position," and the needle drop position that comes after the first needle drop position in the needle drop order will be referred to as a "second needle drop position." The direction in which the feed dog 24 feeds the cloth C will be referred to as a "feed direction," and the feed direction between the first needle drop position and the second needle drop position will be referred to as a "specific feed direction." The first needle drop position is, for example, the needle drop position when the projector 58 performs the projection the previous time, and is included in the first generated image. The second needle drop position is, for example, the current needle drop position P and is included in the second generated image. The specific feed direction is a direction in which the second needle drop position approaches the first needle drop position, and is, for example, a direction from the current needle drop position P toward the needle drop position when the projector 58 performs the projection the previous time.

For example, the CPU 81 can identify the specific feed direction on the basis of the feed amount acquired by the processing at step S21. In the processing at step S22, step S24, or step S26, the CPU 81 may store the first basic image or the first generated image in the RAM 83.

Hereinafter, a stitch that is the same among both the stitches of the first pattern object and the stitches of the second pattern object will be referred to as a "specific stitch." In the processing at step S22, step S24, or step S26, the CPU 81 may perform parallel translation of the first pattern object in the specific feed direction, such that the specific stitch of the second pattern object is positioned in the specific feed direction with respect to the specific stitch of the first pattern object. In other words, in the processing at step S22, step S24, or step S26, the CPU 81 may generate, as the second basic image or the second generated image, an image obtained by moving the first pattern object in the specific feed direction.

According to this configuration, the sewing machine 1 can generate the second basic image or the second generated image on the basis of the first basic image or the first generated image. Thus, the sewing machine 1 contributes to the advantage of being able to suppress a load on the CPU 81 that results from generating the second basic image or the second generated image.

As an example, a case will be described in which, at the time of generating the second basic image A2, the current needle drop position P is the point P2. In this case, the first needle drop position is the point P1, and the second needle drop position is the point P2. The specific feed direction is the direction from the point P2 to the point P1. In the processing at step S22 the previous time, the CPU 81 stores the first basic image A1 in the RAM 83. The CPU 81 identifies the specific feed direction on the basis of the feed amount acquired by the processing at step S21. By the processing at step S22 this time, the CPU 81 acquires the first basic image A1 from the RAM 83. In the first basic image A1, the CPU 81 moves the first pattern object T1 from the point P2 toward the point P1. In other words, the CPU 81 moves the first pattern object T1 such that the point P2 is aligned with the point P1. The CPU 81 generates the second basic image A2 in this way.

As long as the specific feed direction is the direction in which the second needle drop position approaches the first needle drop position, the specific feed direction may intersect the direction from the current needle drop position P toward the needle drop position when the projector 58 performs the projection the previous time. For example, of the forward and rearward directions, the CPU 81 may identify, as the specific feed direction, the direction in which the second needle drop position approaches the first needle drop position. In other words, the position of the point P2 in the second basic image A2 may be separated from the point P1 in the first basic image A1.

Hereinafter, m is a natural number. The value of m and the value of n may be the same, the value of m may be smaller than the value of n, or the value of m may be greater than the value of n. For the second pattern object, the origin point of the second sewing pattern may be the needle drop position when the sewing has progressed by the number of stitches m from the current needle drop position P. According to this configuration, by projecting the second generated image, the sewing machine 1 contributes to the advantage of making it easier for the user to ascertain the plurality of needle drop positions that come after the needle drop position when the needle drop order has progressed by the number of stitches m from the current needle drop position P. For the second pattern object, the origin point of the second sewing pattern may be the needle drop position when the sewing has regressed by the number of stitches m from the current needle drop position P. According to this configuration, by projecting the second generated image, the sewing machine 1 contributes to the advantage of making it easier for the user to ascertain the plurality of needle drop positions that come after the needle drop position when the needle drop order has regressed by the number m of stitches m from the current needle drop position P.

The configuration of the sewing machine 1 may be changed as appropriate. The sewing machine 1 may be an industrial sewing machine. The sewing machine 1 may sew an embroidery pattern on the cloth C. The embroidery pattern is a type of the sewing pattern, and is a character, a graphic, or the like. The embroidery pattern is formed by embroidery. More specifically, an embroidery frame is provided at the bed 11 such that the embroidery frame can move in the front-rear direction and the left-right direction. The embroidery frame holds the cloth C. The sewing machine 1 sews the embroidery pattern on the cloth C by moving the embroidery frame in the front-rear direction and the left-right direction on the basis of embroidery pattern sewing data. The embroidery pattern sewing data prescribes data for moving the embroidery frame for each of stitches configuring the embroidery pattern. In this case, in the processing at step S21, for example, the CPU 81 may acquire a movement amount of the embroidery frame on the basis of the embroidery pattern sewing data. The CPU 81 may switch the first generated image that is being projected to the second generated image during the sewing, on the basis of the acquired movement amount of the embroidery frame.

Of the front-rear direction and the left-right direction, the feed dog 24 may be configured to only be able to feed the cloth C in the front-rear direction, for example. The sewing machine 1 need not necessarily be provided with the oscillating mechanism 57. In other words, using one of the feed dog 24 or the oscillating mechanism 57, the sewing machine 1 may move the cloth C in the left-right direction relative to the needle bar 6, or the sewing machine 1 may not be able to move the cloth C in the left-right direction relative to the needle bar 6.

Until the CPU 81 executes the program, the sewing machine 1 may store the control program in a storage device (the flash memory 84, for example) of the sewing machine 1. Thus, each of an acquisition method of the control program, an acquisition path, and a storage device for storing the control program may be changed as appropriate. For example, the sewing machine 1 may receive the control program from an external device by a wired or wireless method, and may store the control program in the flash memory 84. The external device is a PC, a server, and the like.

As the storage device, in addition to the flash memory 84 or in place of the flash memory 84, the sewing machine 1 may be provided with a removable medium, or a non-portable medium. The removable medium is, for example, a magnetic disk, a magneto-optical disk, an optical disk, or a semiconductor memory. The non-portable medium is, for example, a built-in hard disk drive, or a built-in solid state drive (SSD).

In addition to the CPU 81 or in place of the CPU 81, the sewing machine 1 may be provided with another control device. The other control device is an ASIC, a GPU, or the like. The sewing machine 1 may perform each of the steps of the main processing using distributed processing by a plurality of control devices (a plurality of CPUs, for example). For example, the sewing machine 1 may be provided with a projection control device and a sewing control device. The projection control device controls the generation of the generated image and the projection of the generated image by the projector 58. The sewing control device controls the sewing by the sewing machine 1. In this case, for example, the projection control device performs the main processing, and in the processing at step S31, transmits, to the sewing control device, a sewing command to sew the number of stitches n. The sewing control device controls the sewing on the basis of the sewing command received from the projection control device.

In the main processing, the sewing machine 1 may change a processing order of each of the steps, may omit some of the steps, or may add other steps. For example, the CPU 81 may cause the projector 58 to project the generated image by the processing at step S32 before controlling the sewing of the number of stitches n by the processing at step S31. For example, the CPU 81 may omit some or all of the processing at step S23 to step S26.

The sewing machine 1 may change an attachment position of the projector 58 from the above-described embodiment. The sewing machine 1 may change the shape, the size, and the position of projection region RC as appropriate. For example, the projection region RC need not necessarily include the current needle drop position P, and it is sufficient that the projection region RC includes a region of at least part of the bed 11, in a state in which the cloth C is not placed on the bed 11.

The shape of each of the first guide object G1 and the second guide object G2 may be a shape that is different from that of the above-described embodiment. Each of the first guide object G1 and the second guide object G2 may include only one of the horizontal line GH or the vertical line GV, and each of the horizontal line GH and the vertical line GV may be lines arranged in a plurality thereof in a lattice shape (so-called grid lines), frame lines, or one or a plurality of dots, or the like. The shape of the first guide object G1 and the shape of the second guide object G2 may be different from each other. The position of the first guide object G1 with respect to the first generated image and the position of the second guide object G2 with respect to the second generated image may be different from each other. The first generated image need not necessarily include the first guide object G1. The second generated image need not necessarily include the second guide object G2.

The n value setting table may establish the value of n such that the value of n becomes smaller the greater the sewing speed. The CPU 81 may set the value of n in accordance with the sewing speed, without referring to the n value setting table. The CPU 81 may set the value of n to a predetermined value, irrespective of the sewing speed. In this case, the value of n is not limited to a particular value. A configuration may be adopted in which the user can set the value of n.

The second generated image may indicate one or both of a status of the sewing and a state of the cloth C using changes in color. Hereinafter, it is assumed that a first color and a second color are mutually different colors. For example, when the sewing speed is higher than a predetermined speed, the second generated image may indicate the background or a specific object using the first color (red, for example), and when the sewing speed is equal to or less than the predetermined speed, may indicate the background or the specific object using the second color (blue, for example). When the cloth C is not displaced, the second generated image may indicate the background or the specific object using the first color (white, for example), and when the cloth C is displaced, may indicate the cloth C using the second color (red, for example). In this case, in addition to the extent of progress of the sewing, the user can ascertain the status of the sewing and the state of the cloth C using the projection image. Note that "the cloth C is displaced" refers, for example, to a situation in which there is a difference between the feed amount identified by the CPU 81 on the basis of the sewing data and the actual feed amount of the cloth C. Alternatively, "the cloth C is displaced" refers to a situation in which, for example, a prescribed position is set in the sewing machine 1 as a position at which any of the ends of the cloth C is to be arranged, and the end of the cloth C is separated from the prescribed position.

A configuration may be adopted in which the user can set, using he panel operation, for example, whether or not the CPU 81 is to perform the switching of the projection image in the processing at step S32. When the user sets that the CPU 81 is to perform the switching of the projection image in the processing at step S32, the CPU 81 need not necessarily generate the second generated image. In this case, the sewing machine 1 contributes to the advantage of being able to suppress a load on the CPU 81, which results from the control of the generation and projection of the second generated image, from increasing unnecessarily.

The CPU 81 may cause the projector 58 to project the first generated image from before the start of the sewing. The CPU 81 need not necessarily generate the basic image each time the CPU 81 causes the projector 58 to project the generated image by the processing at step S32. In this case, the CPU 81 may generate the basic image at a time point at which the CPU 81 acquires the sewing data by the processing at step S15. In this case, since the CPU 81 generates the generated image at the start of the sewing, the sewing machine 1 contributes to the advantage of being able to suppress the load on the CPU 81 that results from the control of the generation and projection of the generated image during the sewing.

The CPU 81 may detect the marker M using a sensor other than the camera 50. The sensor other than the camera 50 is an optical sensor, for example. The user may input the stop position to the sewing machine 1 using the panel operation. In this case, the CPU 81 may acquire the input stop position.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine that sews a sewing pattern on a sewing object placed on a bed, the sewing machine comprising:

a sewing machine motor configured to drive a needle bar in an up-down direction;

a projector configured to project an image toward the bed;

a processor; and a memory storing computer-readable instructions that, when executed by the processor, cause the processor to perform processes comprising:

generating processing of generating a first image including a first object representing a first sewing pattern, the first sewing pattern being at least a part of the sewing pattern and being a state in which a sewing by the sewing machine is incomplete, and generating a second image including a second object representing a second sewing pattern, the second sewing pattern being a part of the sewing pattern and being a state in which the sewing has progressed further than the first sewing pattern; and projection processing of, after causing the projector to project the first image generated by the generating processing, switching the projected first image, during a driving of the needle bar by the sewing machine motor, to the second image generated by the generating processing, and causing the projector to project the second image.

2. The sewing machine according to claim 1, wherein the computer-readable instructions further cause the processor to perform a process comprising:

acquisition processing of acquiring a feed amount of the sewing object, and the projection processing includes switching the projected first image to the second image during the driving of the needle bar by the sewing machine motor, based on the feed amount acquired by the acquisition processing.

3. The sewing machine according to claim 2, further comprising:

a feed amount detection sensor configured to detect the feed amount, wherein the acquisition processing includes acquiring the feed amount detected by the feed amount detection sensor.

4. The sewing machine according to claim 3, wherein the feed amount detection sensor is a camera configured to capture the sewing object, and the acquisition processing includes acquiring the feed amount based on a captured image representing the sewing object captured by the camera.

5. The sewing machine according to claim 1, wherein the projection processing includes switching the projected first image to the second image when the sewing progresses by a number of stitches n, n being a natural number.

6. The sewing machine according to claim 5, wherein the computer-readable instructions further cause the processor to perform a process comprising:

setting processing of setting a value of n in accordance with a sewing speed.

7. The sewing machine according to claim 1, wherein the computer-readable instructions further cause the processor to perform a process comprising:

clocking processing of measuring a time period, and the projection processing includes switching the projected first image to the second image when the time period measured by the clocking processing reaches a predetermined time period.

8. The sewing machine according to claim 7, wherein the computer-readable instructions further cause the processor to perform a process comprising:

setting processing of setting a value of the predetermined time period in accordance with a sewing speed.

9. The sewing machine according to claim 1, wherein the sewing machine performs a sewing on the sewing object by a sewing needle mounted to the needle bar dropping in order of a plurality of needle drop positions in the sewing object, the generating processing includes, while taking a specific needle drop position of the plurality of needle drop positions as an origin point or taking the needle drop position advanced by a number of stitches m, m being a natural number, from the specific needle drop position of the plurality of needle drop positions as the origin point, generating the second image that includes the second object representing, as the second sewing pattern, the plurality of needle drop positions after the origin point in the order in which the sewing needle drops, in order from the origin point.

10. The sewing machine according to claim 9, wherein the generating processing includes, while taking the specific needle drop position as the origin point, generating the second image that includes the second object representing, as the second sewing pattern, the plurality of needle drop positions after the origin point in the order in which the sewing needle drops, in order from the origin point.

11. The sewing machine according to claim 1, further comprising:

a feed dog provided in the bed and configured to feed the sewing object, wherein the computer-readable instructions further cause the processor to perform a process comprising:

storing processing of storing the first image, and the generating processing includes generating, as the second image, an image obtained by moving the first object included in the first image stored by the storing processing in a direction in which the feed dog feeds the sewing object.

12. The sewing machine according to claim 1, wherein the sewing machine performs a sewing on the sewing object by a sewing needle mounted to the needle bar dropping in order of a plurality of needle drop positions in the sewing object, the computer-readable instructions further cause the processor to perform a process comprising:

storing processing of storing the first image, and the generating processing includes generating the first image including the first object representing the first sewing pattern that includes a first needle drop position, of the plurality of needle drop positions, and generating, as the second image including the second object representing the second sewing pattern that includes a second needle drop position, an image obtained by moving the first object included in the first image stored by the storing processing in a direction in which the second needle drop position approaches the first needle drop position, the second needle drop position being a needle drop position coming after the first needle drop position, of the plurality of needle drop positions, in the order in which the sewing needle drops.

13. The sewing machine according to claim 1, further comprising:

a camera configured to detect a state of the sewing object, wherein the generating processing includes generating the second image reflecting the state of the sewing object detected by the camera.

14. The sewing machine according to claim 1, further comprising:

a camera configured to detect a stop position of the sewing, wherein when the sewing pattern is a practical pattern obtained by repeating a unit pattern a plurality of times, the unit pattern being a pattern that is established in advance, the generating processing includes generating, as the second sewing pattern, the second image including the second object representing the practical pattern in which the unit patterns are repeated up to the stop position detected by the camera.

15. The sewing machine according to claim 1, wherein the generating processing includes generating the first image and the second image each including a third object representing a reference position for positioning the sewing object, a shape of each of the third objects being the same, and a position of each of the third objects with respect to the first image and the second image being the same, respectively.

* * * * *